US005730582A

United States Patent [19]

Heitmann

[11] Patent Number: 5,730,582

[45] Date of Patent: Mar. 24, 1998

[54] IMPELLER FOR RADIAL FLOW DEVICES

[75] Inventor: Arnold M. Heitmann, Swampscott, Mass.

[73] Assignee: Essex Turbine Ltd., Swampscott, Mass.

[21] Appl. No.: 783,653

[22] Filed: Jan. 15, 1997

[51] Int. Cl.[6] ..... B63H 1/16

[52] U.S. Cl. ..... 416/188; 416/185; 416/223 B; 416/DIG. 2

[58] Field of Search ..... 416/183, 185, 416/188, 176, 177, 223 A, 223 B, DIG. 2; 415/71; 249/135

[56] References Cited

U.S. PATENT DOCUMENTS

| | | | |
|---|---|---|---|
| 1,959,703 | 5/1934 | Birmann . | |
| 2,484,554 | 10/1949 | Concordia et al. . | |
| 3,536,417 | 10/1970 | Stiefel et al. . | |
| 3,598,169 | 8/1971 | Copley | 164/60 |
| 3,644,056 | 2/1972 | Wiselius . | |
| 4,093,401 | 6/1978 | Gravelle | 416/188 |
| 4,146,353 | 3/1979 | Carrouset . | |
| 4,204,807 | 5/1980 | Takizawa et al. | 416/188 |
| 4,362,468 | 12/1982 | Nishikawa et al. | 416/188 |
| 4,417,855 | 11/1983 | Jepsen . | |
| 4,520,541 | 6/1985 | Miki et al. . | |
| 4,652,212 | 3/1987 | Burger et al. | 416/188 |
| 4,653,976 | 3/1987 | Blair et al. . | |
| 4,904,158 | 2/1990 | Kun . | |
| 5,213,473 | 5/1993 | Fiala | 416/185 |
| 5,242,268 | 9/1993 | Fukazawa et al. | 416/223 B |
| 5,372,477 | 12/1994 | Cole | 416/223 B |
| 5,639,217 | 6/1997 | Ohtsuki | 416/183 |

FOREIGN PATENT DOCUMENTS

| | | |
|---|---|---|
| 2 206 175 | 2/1972 | Germany . |
| 58-170899 | 10/1983 | Japan . |
| 50-103999 | 6/1984 | Japan . |
| 693727 | 7/1953 | United Kingdom . |
| 761187 | 11/1956 | United Kingdom . |

*Primary Examiner*—Thomas E. Denion
*Attorney, Agent, or Firm*—Lappin & Kusmer LLP

[57] ABSTRACT

An impeller for a radial flow device selected from the group consisting of radial—and mixed-flow compressors, pumps and turbines which is designed for both aerodynamic performance and manufacturability at high production rates. The mean blade surface of the impeller is substantially helical, as the angle of any point on the mean blade surface relative to a meridional plane passing through the axis of rotation of the impeller varies linearly with the radius and z-axis location of that point relative to an arbitrary radial plane $z_0$. A single-piece mold for making the impeller, and a method for making the mold, are also disclosed. The impeller can made in a high-speed molding process without significant post-production processing, and it can be easily withdrawn from a mold without destruction or disassembly of the mold.

3 Claims, 8 Drawing Sheets

IMPELLER FOR RADIAL FLOW DEVICES

FIELD OF THE INVENTION

The present invention relates to radial flow devices, including centrifugal and mixed-flow compressors, turbines and pumps of the kinematic type, and more particularly to improvements in impeller designs for such devices.

BACKGROUND OF THE INVENTION

Radial flow devices, such as centrifugal and mixed-flow compressors, turbines and pumps, typically operate by taking in a fluid (gas or liquid) and either adding or subtracting energy from the fluid by kinematic means. In a compressor or a pump, energy is added to the fluid, and fluid pressure is increased, by the interaction of rotating blades or vanes with the fluid as it passes through the device. In contrast, energy is removed from the fluid in a turbine, and fluid pressure is decreased, as a result of fluid interaction with rotating blades or vanes as it passes through the device.

Radial flow compressors and pumps are typically constructed with a relatively small diameter fluid inlet zone and a relatively large diameter fluid outlet zone. Turbines are typically constructed with a relatively large diameter fluid inlet zone and a relatively small diameter fluid outlet zone.

The terms "axial" and "axis of rotation", as used herein, refer to the z axis, about which the impeller in a radial flow device rotates, regardless of whether the device is a compressor, pump or turbine. In so-called "axial flow" devices, fluid flows into or out of the device in the direction of the axis of rotation. The terms "radial" and "radial plane", as used herein, refer to a plane which is normal to the z axis. Radial distances are measured from the z-axis. The terms "meridian" and "meridional plane", as used herein, refer to a plane which passes through the z axis and is thus normal to a radial plane. The term "mean blade surface" or "mean profile", as used herein, refers to the theoretical mean surface, or profile (dimensionless), of a blade (or, when discussing a mold used to make the impeller, a blade cavity of a mold). The blade or blade cavity is then given thickness and shape by adding dimension to both sides of the mean blade surface. The angle $\theta$ (theta) refers to an angle in the radial plane that the mean blade surface makes, at a specified point P(r,z) at radius r and axial position z, with a reference meridional plane. The blade angle at any point relative to a meridional plane and the direction of fluid flow at that point is designated as $\beta$ (beta). All blade dimensions are indicated relative to an arbitrary plane normal to the z axis and typically passing through the leading edge of a blade in a compressor or pump, or the trailing edge of a blade in a turbine; this plane is typically referenced as $z_0$.

In so-called "radial-flow" devices, whether they are compressors, pumps or turbines, fluid flows into or out of the device in the radial direction, normal to the axis of rotation of the device. "Mixed-flow" devices incorporate both radial and axial fluid flow into and out of the device. Regardless of flow type, radial flow devices are designed to add or subtract energy from a fluid by kinematic means, and the technology employed to accomplish this objective is well understood.

The blades of an impeller are shaped to intercept the fluid flow paths so as to provide the desired energy input into or output from the fluid while maintaining thermodynamic equilibrium throughout the device. A principal objective of impeller design is to select the values for $\beta$ throughout the entire flow path in order to achieve the desired work input or output from the fluid. The blade angle must therefore be controlled along the entire flowpath length of the blade.

The blade design in prior art impellers has been generally dictated by the desired aerodynamic performance properties of the device, resulting in complex three-dimensional blade shapes which are difficult and costly to manufacture in any relatively large quantity. If the parts are made by a molding process to control manufacturing costs, it is necessary to construct individual molds which must either be disassembled or destroyed after each use in order to remove the part. The costs of production and labor are high as a result. In addition, such parts frequently require post-production machining to achieve the desired blade shape, which further increases production costs. Thus, it has heretofore been impractical to manufacture an impeller having complex blades shapes which delivers aerodynamically acceptable performance at high production rates using mass production techniques, such as injection or compression molding.

It would therefore be an advantage in the art to provide an improved impeller design for radial flow devices which combines economical manufacturability at high production rates with satisfactory aerodynamic performance.

OBJECTS OF THE INVENTION

It is an object of the present invention to provide an impeller for a radial flow device which provides acceptable aerodynamic performance and can be made in relatively large quantities at relatively low cost.

Another object of the present invention is to provide an impeller for a radial flow device which can be produced economically in an injection or compression molding process without costly and labor-intensive post-production operations.

Still another object of the present invention is to provide a method of making an impeller for a radial flow device by a molding process, such as injection or compression molding, with a reusable, single-piece mold for the impeller.

And another object of the present invention is to provide a single-piece, reusable mold for making an impeller for radial flow devices, from which the impeller can be easily removed without destroying the mold.

Still another object of the present invention is to provide a method of making a single-piece, reusable mold for an impeller for radial flow devices.

Yet another object of the present invention is to provide a radial flow device which operates with less aerodynamic noise relative to prior art radial flow devices.

SUMMARY OF THE INVENTION

The impeller of the present invention features a blade design that permits the impeller to be economically manufactured at high production rates without sacrificing aerodynamic performance. The design incorporates a helical mean blade surface which facilitates the removal of the impeller from a single-piece mold without destruction of the mold. Because the mold can be reused, substantial savings in material and labor cost can be realized. In addition, because the designer has the ability to shape the blades in the flow direction to achieve the desired $\beta$ distribution, he can design the blade to achieve both the desired aerodynamic and manufacturability objectives.

A rotary impeller for a radial flow device, such as a radial- or mixed-flow compressor, turbine or pump, extends about an axis of rotation and includes a solid hub with a plurality of blades extending from the hub. The blades are adapted for channeling fluid flowing through the device. According to one aspect of the invention, the blades of the impeller have a substantially helical mean surface. The angle $\theta$ of the mean surface of a blade at any point P(r,z) at a given radius r from the axis of rotation and at any given z-axis distance from a radial plane $z_0$ normal to the axis of rotation is expressed by the equation $$\theta=cz_r+\theta_0.$$

In this equation, $z_r$ is the distance from the radial plane $z_0$ to the point P (r,z) on the mean blade surface at the radius r, $\theta_0$ is the angle of the mean blade surface at the radius r and the radial plane $z_0$, c is a constant value representative of the ratio of change in $\theta$ to change in z, and $\theta$ is measured in a radial plane relative to a meridional plane M extending through the axis of rotation.

The radial flow device can include a stationary shroud which surrounds at least a portion of the impeller. The shroud extends about the axis of rotation and is spaced along the axis from the hub. The fluid flow path is thus bounded by the hub, the shroud and the blades.

According to another aspect of the invention, there is provided a single-piece mold for a rotary impeller for a radial flow device selected from the group consisting of radial—and mixed-flow compressors, turbines and pumps. The mold extends about an axis of rotation and comprises a housing defining a hub cavity extending about the axis of rotation, and a plurality of blade cavities extending from the hub cavity. The hub cavity and the blade cavities are adapted to releasably receive a material suitable for molding. The mean profile of each of the blade cavities is substantially helical. The angle $\theta$ of the mean profile of a blade cavity at any point P(r,z) at a given radius r from the axis of rotation and at any given z-axis distance from a radial plane $z_0$ normal to the axis of rotation is expressed by the equation $$\theta=cz_r+\theta_0.$$

In this equation, $z_r$ is the distance from the radial plane $z_0$ to the point P (r,z) on the mean blade profile at the radius r, $\theta_0$ is the angle of the mean blade profile at the radius r and the radial plane $z_0$, c is a constant value representative of the ratio of change in $\theta$ to change in z, and $\theta$ is measured in a radial plane relative to a meridional plane M extending through the axis of rotation.

According to another aspect of the invention, there is provided a method of making a single-piece mold for a rotary impeller for a radial flow device selected from the group consisting of radial- and mixed-flow compressors, turbines and pumps. The method comprises the steps of:

A. providing a mold substrate made of a material suitable for forming a mold cavity therein;

B. providing electric discharge machining apparatus, including a power supply and at least one electrically conductive electrode, the electrode being provided substantially in the shape and size of the impeller to be molded; and C. establishing an electrical circuit between the power supply and the electrode, and driving the electrode into the mold substrate material with a combination of rotational and axial force while simultaneously passing sufficient current through the electrode to remove sufficient material from the mold substrate to form a mold cavity therein. The mold cavity thus formed is substantially in the shape and size of the impeller to be molded.

In a preferred embodiment, the mold substrate material comprises a hardened steel and the electrically conductive electrode is made of graphite. Because of the consumable nature of a graphite electrode, multiple electrodes can be used to form the mold cavity.

As will be explained in greater detail below, the impeller blades, and in particular the leading edges of compressor and pump impeller blades and the trailing edges of turbine impeller blades, need not be radial, i.e., they need not extend radially from the center of rotation of the impeller. The center lines of the blades at their leading edges may be offset from a meridian by any angle or combination of angles, provided that, at any radial distance from the z axis, the change in blade angle with change in z-axis position is constant for all points at that radius. This requirement permits the impeller blades to be designed aerodynamically and to be rotated easily out of a mold.

An impeller according to the invention can thus be designed to achieve the desired $\beta$ distribution along the fluid flow path while specifying a fixed value for the change in $\theta$ with change in z axis location and a value for $\theta_0$ at $z_0$ and for $\theta$ along the shroud profile, or by specifying values for $\theta$ along the hub profile. Once these values are specified, the impeller can be made in, and extracted from, a single-piece mold as long as the mean blade surface at any given radius satisfies equation $\theta=cz+\theta_0$.

These and other features of the invention will be more fully appreciated with reference to the following detailed description which is to be read in conjunction with the attached drawings.

BRIEF DESCRIPTION OF THE DRAWINGS

The invention is further described by the following description and figures, in which.

Like elements in the respective FIGURES have the same reference numbers.

DETAILED DESCRIPTION OF THE PREFERRED EMBODIMENT

Figure 2:
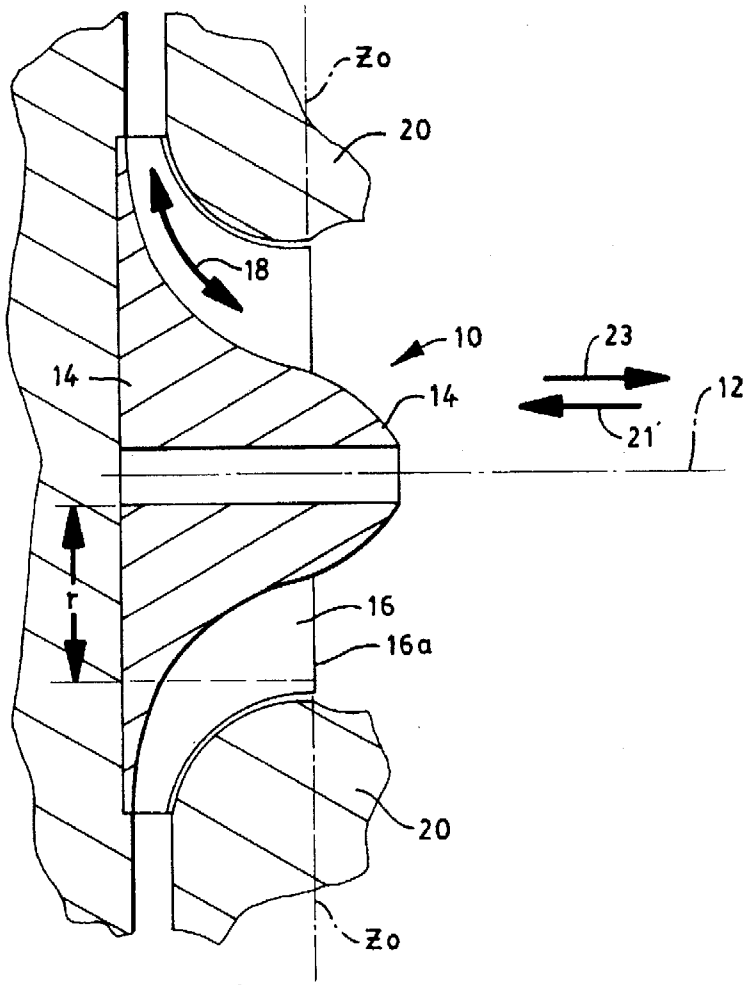
FIG. 2 PRIOR ART
FIG. 2 is a sectional view of the impeller of FIG. 1 along section lines I—I.
Figure 1:
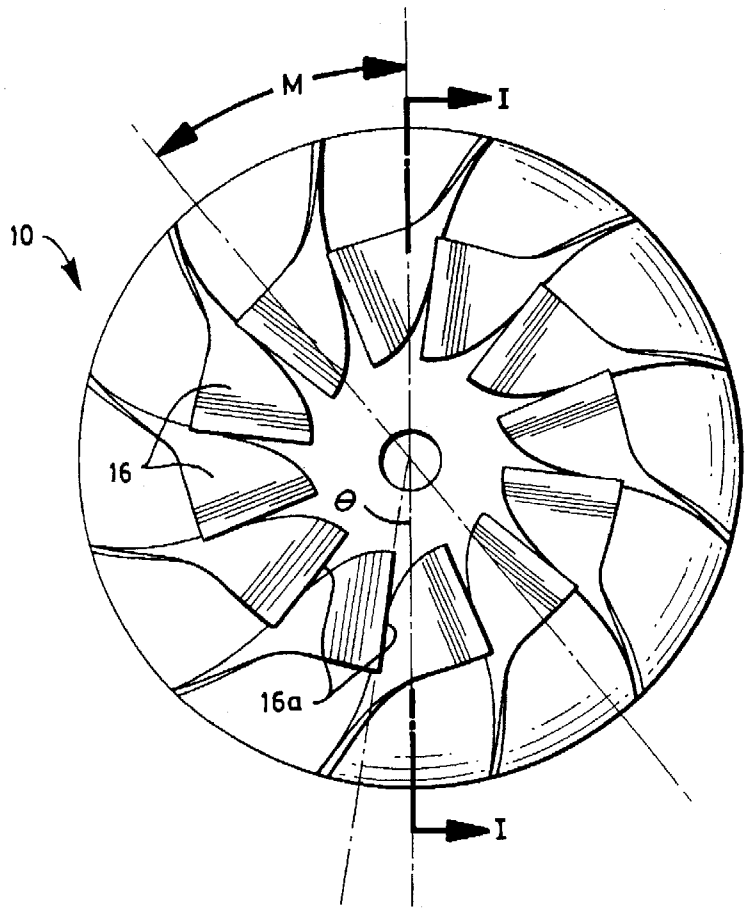
FIG. 1 PRIOR ART
FIG. 1 is an axial view of a typical rotary impeller for a centrifugal compressor showing the conventional terminology for a discussion of a radial flow device.

FIGS. 1 and 2 show the terminology of a radial flow devices, and impellers for such devices in particular. Radial flow devices typically include an impeller 10 which extends and rotates about an axis of rotation 12, commonly referred to as the z axis. The impeller includes a hub 14 from which a plurality of vanes or blades 16 extend. The blades 16 define a plurality of parallel fluid flow paths or streams 18 through the device. The device can also include a stationary shroud 20 which also extends about the z axis 12 and at least partially surrounds the impeller 10 to constrain or confine the fluid flow paths. Fluid flows in the direction of arrow 21 for compressors and pumps and in the direction of arrow 23 for a turbine.

Figure 3:
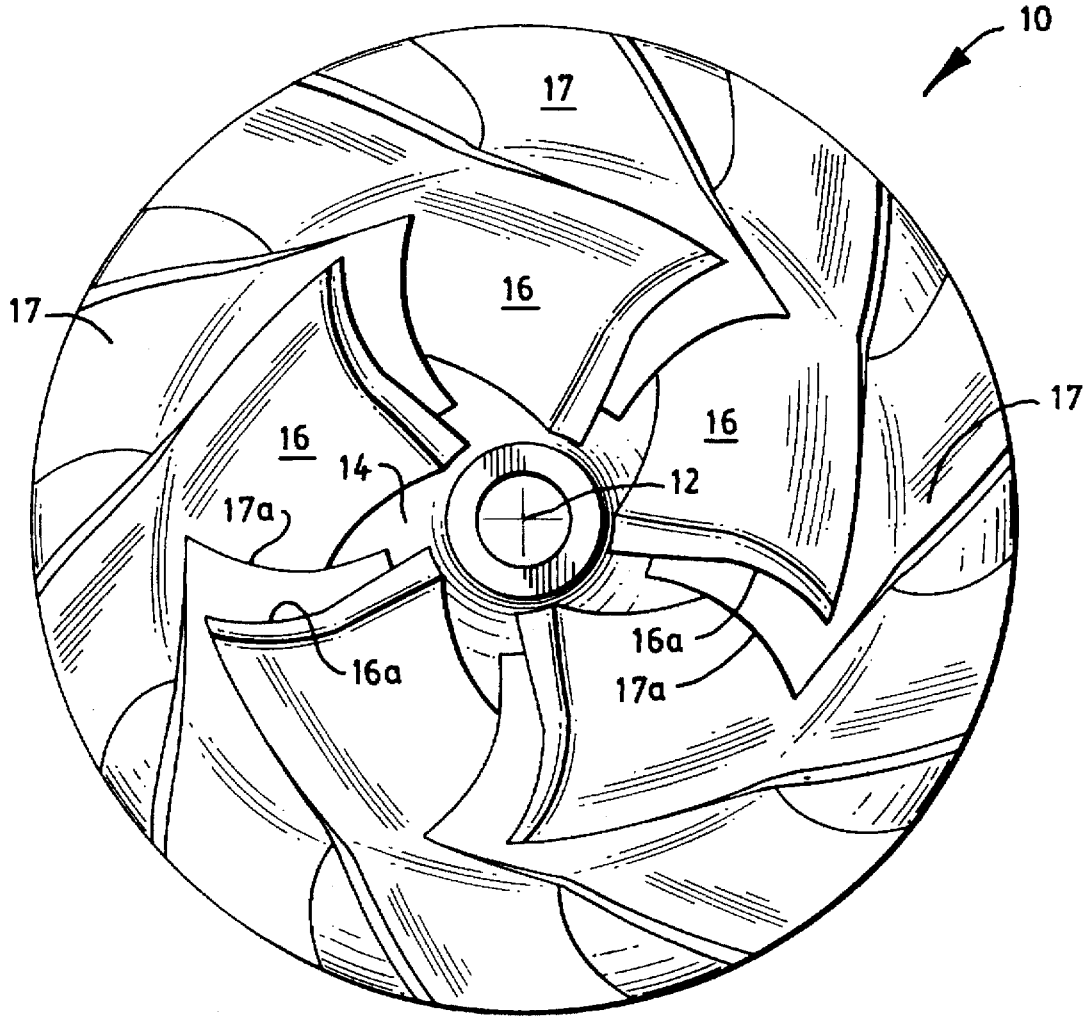
FIG. 3 is an axial view of a rotary impeller for a typical compressor according to the present invention.
Figure 4:
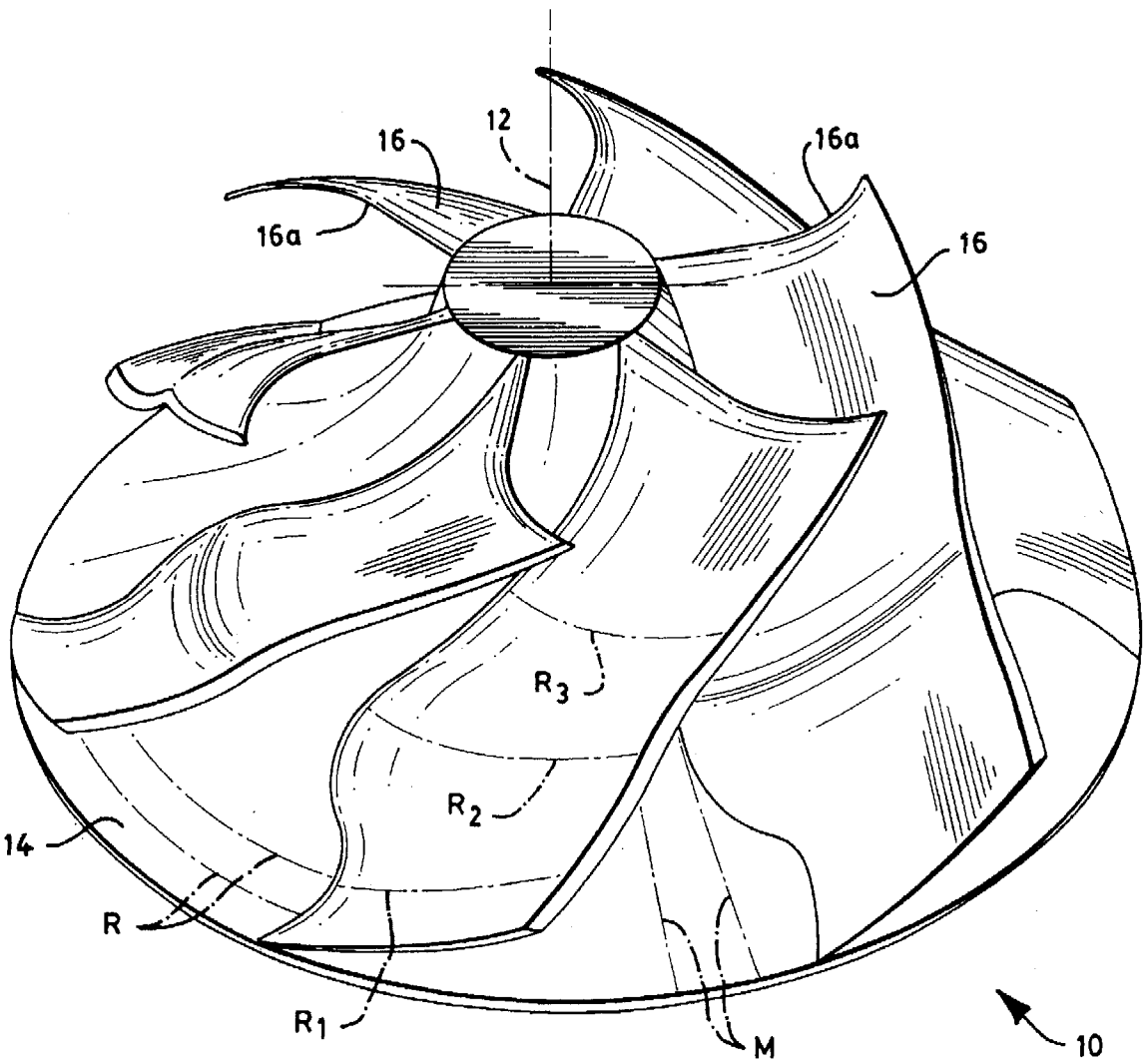
FIG. 4 is a perspective view of a rotary impeller for a typical compressor according to the present invention.

FIGS. 3 and 4 illustrate an impeller 10 for a typical compressor according to the present invention. It should be noted that the principles of the invention extend to turbines as well as compressors, and a compressor impeller has been chosen for illustration in several of the FIGURES merely for convenience and as one example of an application for the invention.

The impeller 10 extends about an axis of rotation 12 and includes a plurality of blades 16 extending from a hub 14 to define a plurality of fluid flow paths 18. The impeller of FIG. 4 includes radial lines R which indicate different radii of the hub 14, and meridional lines M which indicate different meridional planes passing through the axis of rotation 12.

In the impeller of FIGS. 3 and 4, the leading edges 16*a* of the blades 16 do not extend radially from the center of the impeller, in contrast to the blade edges in the prior art impeller of FIG. 1. The freedom to select other than a radial leading blade edge is an important feature of the invention. The ability to select a non-radial leading edge angle for each blade also facilitates the design of a blade having a suitable blade angle distribution along the entire flow path length of that blade. In addition, selection of a non-radial leading edge angle for each blade reduces aerodynamic noise as a result of angular distribution of separation vortices away from the leading edges of the blades.

The impeller illustrated in FIG. 3 includes both primary blades 16 and secondary blades 17. Primary blades 16 of a compressor impeller have their leading axial edges 16*a* at $z_0$, the point at which fluid enters the device. Secondary blades 17 have leading axial edges 17*a* which are set back some distance along the axis of rotation 12 (into the plane of the page). The secondary blades 17 must conform to the same radial and z axis specifications as those of the primary blades 16 for a blade system to meet both the aereodynamic and manufacturability objectives set forth in this disclosure of the present invention.

The impeller of FIG. 4 includes only primary blades 16 which have their leading edges 16*a* substantially coincident with the $z_0$ plane. The blades 16 of the impeller of FIG. 4 include non-radial leading edges 16*a*. The blades have an unusual shape, as evidenced by the irregular curves and bulges in the blade at different radii $R_1$, $R_2$, $R_3$. However, the equation $\theta=cz_r+\theta_0$ is satisfied.

Figure 5:
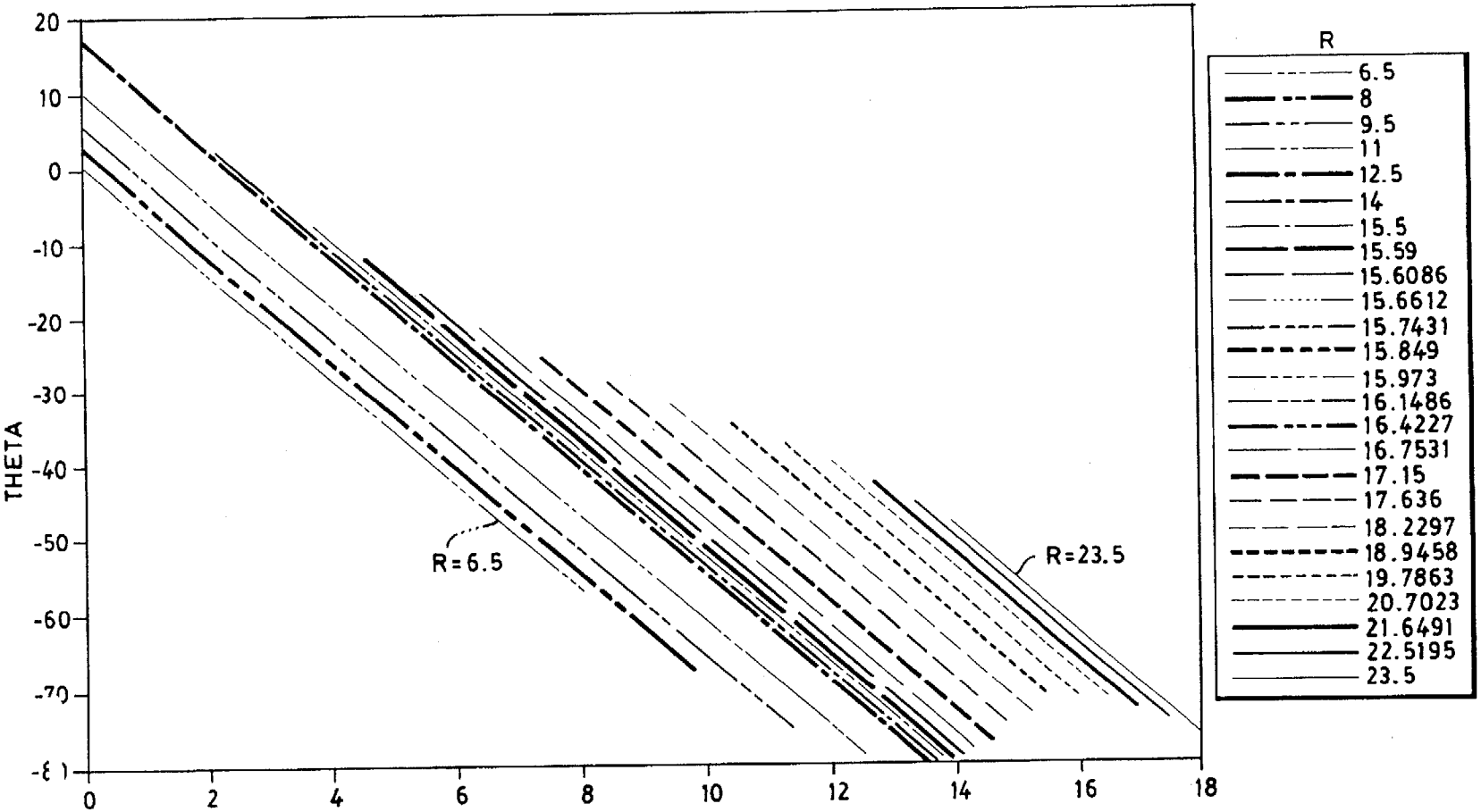
FIG. 5 is a graph showing the relationship between blade angle $\theta$ and z-axis location of the blade at several different radial distances from the z-axis for an impeller according to the present invention.

FIG. 5 is a graph which illustrates the linear relationship of blade angle θ with z-axis position of the blade. Each of the parallel lines shown in the graph represents the change in blade angle θ with z for a given radial position of the blade. For the impeller illustrated by the graph of FIG. 5, the change in blade angle θ with change in z is linear and is constant, regardless of the radial section chosen.

As can be seen in the graph of FIG. 5, although the variation of blade angle θ with z is a constant, the blade angle θ at any given z-axis location of a blade is different for each radial section of the blade considered at that z-axis location. Thus, there can be multiple different radii for a blade on the impeller at any single z-axis reference point, and θ at each of those radii need not be the same.

Figure 6:
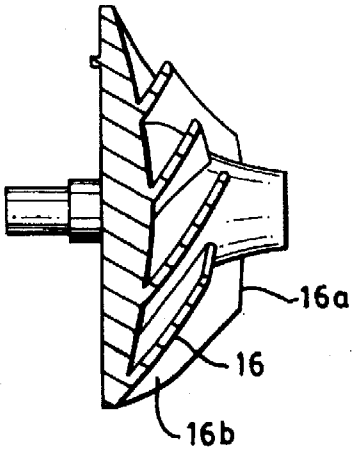
FIG. 6 is a cylindrical sectional view of an impeller according to the present invention, in which the blades all have the same angle at the section radius.
Figure 7A:
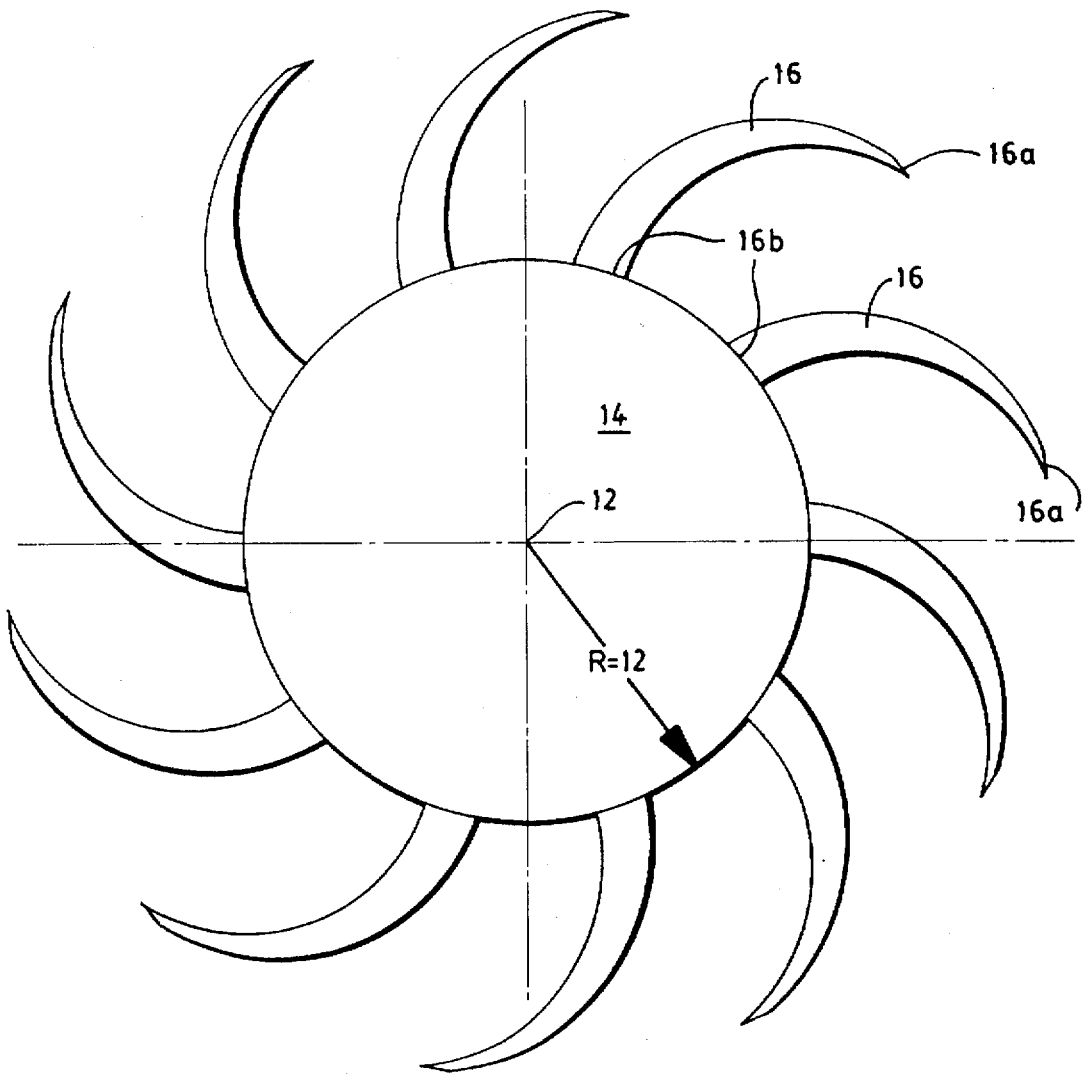
FIGS. 7A–7B are different z-axis section views of an impeller of a typical compressor according to the present invention, illustrating the angular displacement of the blade from a nominal radial location as a function of change in z-axis location.
Figure 7B:
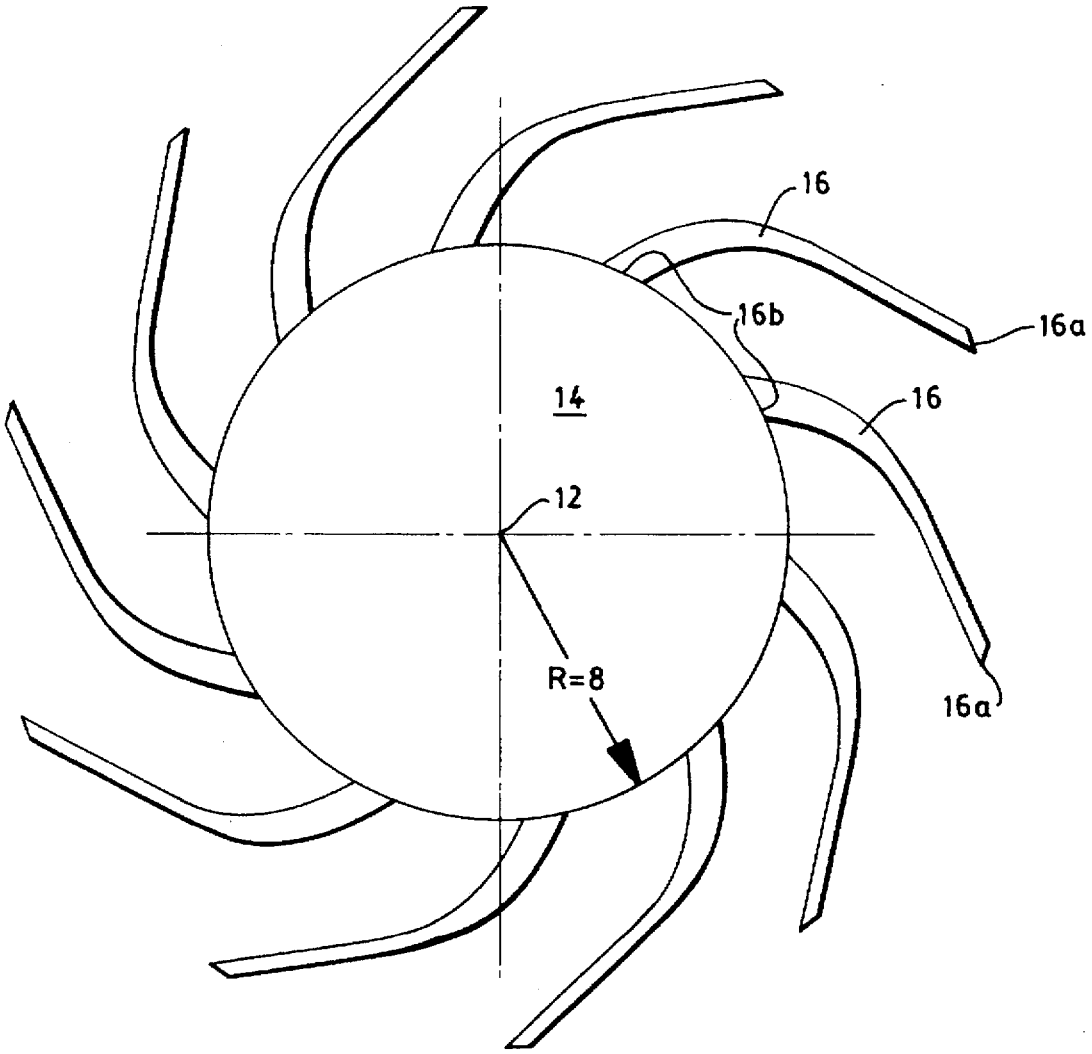

FIG. 6 is a sectional view of an impeller at a particular radius. FIGS. 7A and 7B are radial sections of an impeller at two different z-axis locations. It can be seen that at a given radius and z-axis location, all of the blades 16 on the impeller have the same profile. This feature, along with a sufficient amount of taper from the blade root 16*b* to the leading axial edge 16*a* of the blade, permits the impeller to be extracted from a single-piece mold without destroying or disassembling the mold.

Figure 7C:
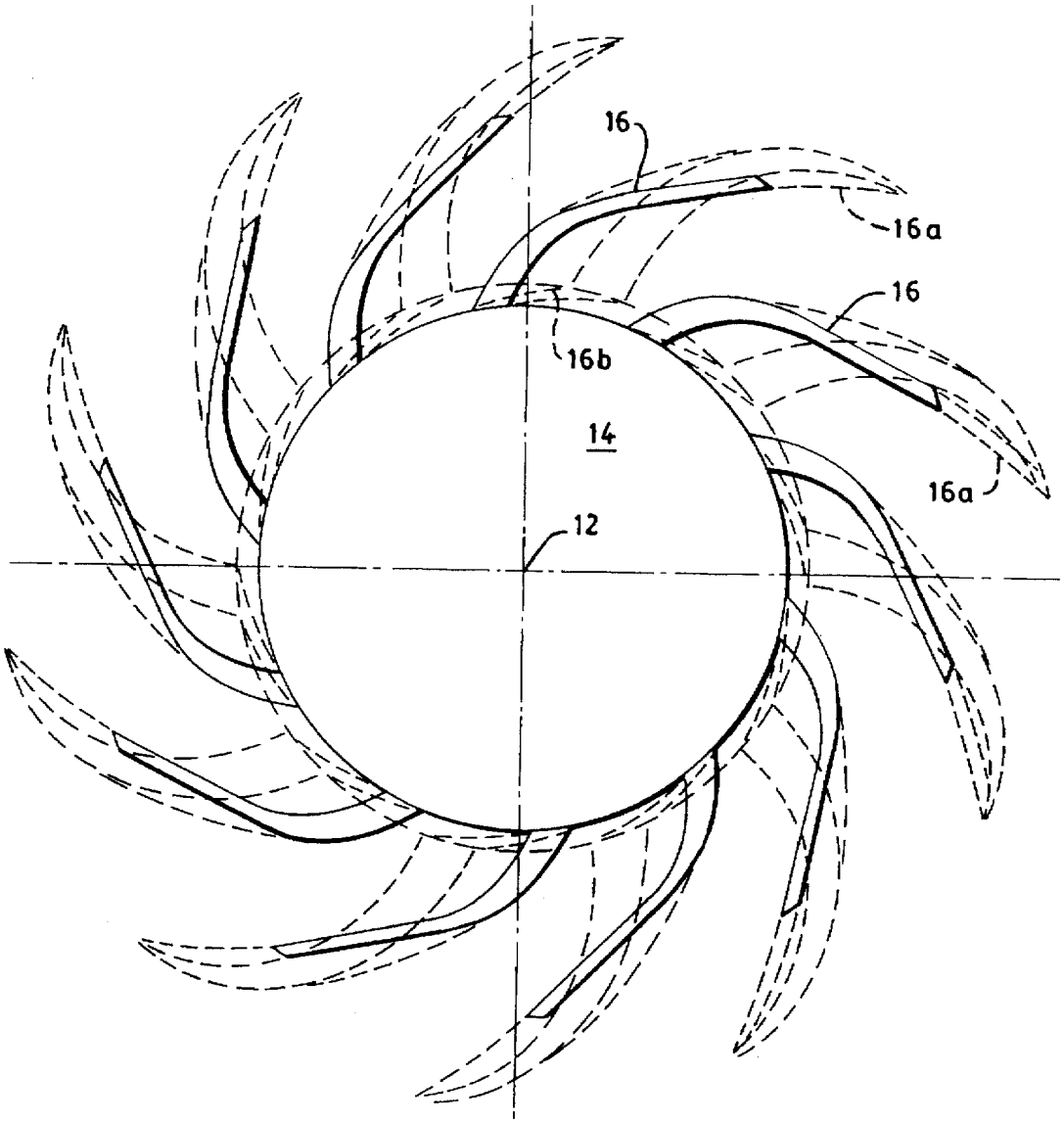
FIG. 7C is the superimposition of FIG. 7B onto FIG. 7A, illustrating the variation in blade profile with different z-axis location of the blade.

FIG. 7C illustrates the development of an impeller according to the invention, in which the difference in θ of the mean blade profile at different radii is indicated graphically by the superimposition of the blade profiles of FIG. 7A and FIG. 7B. It is evident from this view of the impeller blades 16 that the θ of the blades can be significantly varied radially within a given z plane.

Figure 8:
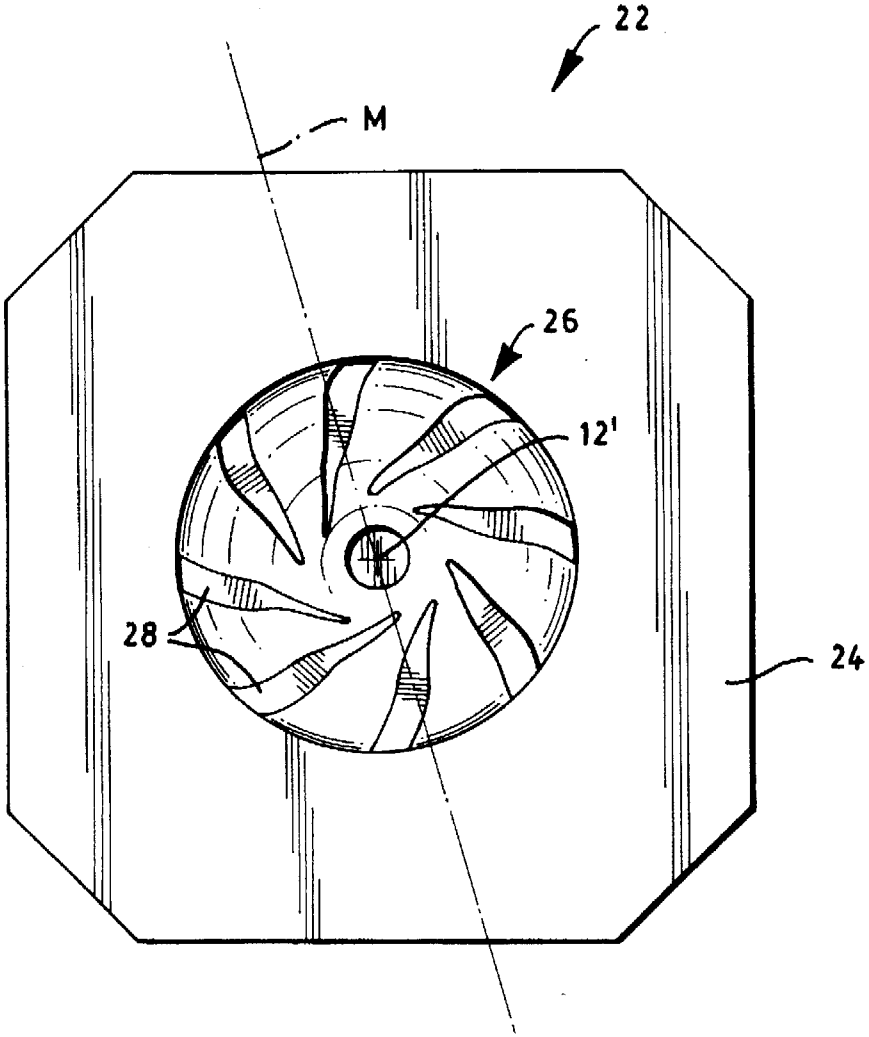
FIG. 8 is an axial view of a mold for an impeller according to the present invention.

FIG. 8 illustrates an axial or plan view of a single-piece mold 22 for making an impeller according to the invention. The mold 22 includes a housing 24 which defines a hub cavity 26 and a plurality of blade cavities 28 extending from the hub cavity. The hub cavity 26 forms a generally conical depression in the mold housing 24. The hub cavity 26 of the mold extends about an axis of rotation 12' which corresponds to the axis of rotation of an impeller made in the mold. The mean profile of each of the blade cavities 28 of the mold corresponds to the mean blade surface of a blade 16 of an impeller produced in the mold and is generally substantially helical.

As previously discussed with regard to the impeller, at any given radial distance r from the axis of rotation 12', the change in θ with change in z axis location of the mean profile of each of the blade cavities 28 is the same and is a constant.

The hub cavity and the blade cavities are adapted to releasably receive a material which is suitable for molding, such as a thermosetting or thermoplastic material.

The mold is preferably manufactured by an electric discharge machining process. According to this process, a mold substrate made of a material suitable for forming a mold cavity therein is provided. An electric discharge machining apparatus, including a power supply and at least one electrically conductive electrode, are also provided. The electrode is formed of a machinable, electrically conductive material, such as graphite, and is made substantially in the shape and size of the impeller to be molded, such that it forms a replica of the impeller to be molded. An electrical circuit is established between the power supply and the electrode, and the electrode is then driven into the mold substrate material with a combination of rotational and axial motion while sufficient current is simultaneously passed through the electrode. Sufficient material is thus removed from the mold substrate in this electric discharge machining process to form a mold cavity therein. The mold cavity is, of course, formed substantially in the shape and size of the replica of the impeller to be molded.

In a preferred embodiment, the mold substrate material comprises a hardened steel or equivalent material. The electrode, if made of graphite, is at least partially consumable under a typical current load of several hundred amps. If necessary, a plurality of such consumable electrodes formed in the shape and size of the impeller to be molded can be used to form the mold cavity.

The resulting mold is of unitary construction and need not be disassembled or destroyed to permit an impeller made therein by conventional injection or compression molding processes to be extracted.

Because of the geometries of the impeller blades which are made possible by the selection of blade angles at any radius which satisfy the equation $\theta=cz+\theta_0$, an impeller made in the single-piece mold of the present invention can be extracted from the mold with a simple combination of rotational and axial motion. Because the mold can be reused and need not be destroyed or disassembled to remove the impeller, mass production of the impellers is possible at greatly reduced cost and at significant savings of labor and material cost.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description. All changes that come within the meaning and range of the equivalency of the claims are therefore intended to be embraced therein.

I claim:

1. In a radial flow device selected from the group consisting of radial— and mixed-flow compressors, turbines and pumps, said device including a rotary impeller extending about an axis of rotation, said impeller including a solid hub and a plurality of blades extending from said hub, wherein said blades are adapted for channeling fluid flowing through said device, the improvement comprising an impeller whose blades have a substantially helical mean surface, wherein the angle θ of the mean surface of a blade at any point P(r,z) at a given radius r from said axis of rotation and at any given z-axis distance from a radial plane $z_0$ normal to said axis of rotation is expressed by the equation $$\theta=cz_r+\theta_0$$

wherein $z_r$ is the distance from said radial plane $z_0$ to said point P (r, z) on said mean blade surface at said radius r, $\theta_0$ is the angle of said mean blade surface at said radius r and said radial plane $z_0$, c is a constant value representative of the ratio of change in θ to change in z, and wherein θ is measured in a radial plane relative to a meridional plane M extending through said axis of rotation.

2. The radial flow device of claim 1, further comprising a stationary shroud surrounding at least a portion of said impeller, said shroud extending about said axis of rotation and being spaced along said axis from said hub, wherein a fluid flow path is defined and bounded by said hub, said shroud and said blades.

3. A single-piece mold for a rotary impeller for a radial flow device selected from the group consisting of radial— and mixed-flow compressors, turbines and pumps, said mold extending about an axis of rotation and comprising:

A. a housing defining a hub cavity extending about said axis of rotation; and

B. a plurality of blade cavities extending from said hub cavity, the mean profile of each of said blade cavities being substantially helical, wherein said hub cavity and said blade cavities are adapted to releasably receive a material suitable for molding, and wherein the angle θ of the mean profile of a blade cavity at any point P(r,z) at a given radius r from said axis of rotation and at any given z-axis distance from a radial plane $z_0$ normal to said axis of rotation is expressed by the equation $$\theta=cz_r+\theta_0$$

wherein $z_r$ is the distance from said radial plane $z_0$ to said point P (r, z) on said mean blade profile at said radius r, $\theta_0$ is the angle of said mean blade profile at said radius r and said radial plane $z_0$, c is a constant value representative of the ratio of change in θ to change in z, and wherein θ is measured in a radial plane relative to a meridional plane M extending through said axis of rotation.

* * * * *